US007651013B2

(12) United States Patent
Laidler et al.

(10) Patent No.: US 7,651,013 B2
(45) Date of Patent: Jan. 26, 2010

(54) OUTLET DEVICE FOR A CONTAINER OR VESSEL

(75) Inventors: Keith Laidler, Stourbridge (GB); Timothy Rodd, Hants (GB)

(73) Assignee: Incro Limited, Stourbridge, West Midlands (GB)

( * ) Notice: Subject to any disclaimer, the term of this patent is extended or adjusted under 35 U.S.C. 154(b) by 602 days.

(21) Appl. No.: 10/525,200

(22) PCT Filed: Aug. 22, 2003

(86) PCT No.: PCT/GB03/03762

§ 371 (c)(1),
(2), (4) Date: Feb. 22, 2005

(87) PCT Pub. No.: WO2004/018111

PCT Pub. Date: Mar. 4, 2004

(65) Prior Publication Data

US 2006/0081658 A1 Apr. 20, 2006

(30) Foreign Application Priority Data

| | | |
|---|---|---|
| Aug. 23, 2002 | (GB) | 0219641.8 |
| Nov. 19, 2002 | (GB) | 0226867.0 |
| Feb. 18, 2003 | (GB) | 0303698.5 |
| Mar. 12, 2003 | (GB) | 0305597.7 |
| Apr. 17, 2003 | (GB) | 0308909.1 |
| May 3, 2003 | (GB) | 0310244.9 |

(51) Int. Cl.
*B65D 83/00* (2006.01)

(52) U.S. Cl. ..... 222/402.13; 222/494

(58) Field of Classification Search . 222/402.1–402.24, 222/491, 494, 571, 389; 137/512.4, 851, 137/859

See application file for complete search history.

(56) References Cited

U.S. PATENT DOCUMENTS

| | | | | | |
|---|---|---|---|---|---|
| 3,991,916 | A | * | 11/1976 | Del Bon | 222/402.13 |
| 5,205,443 | A | * | 4/1993 | Inui et al. | 222/402.13 |
| 5,271,432 | A | * | 12/1993 | Gueret | 137/854 |
| 5,360,145 | A | * | 11/1994 | Gueret | 222/190 |
| 5,413,250 | A | * | 5/1995 | Gueret | 222/105 |
| 5,465,872 | A | * | 11/1995 | Gueret | 222/95 |
| 5,613,517 | A | * | 3/1997 | Handler | 137/512.4 |

FOREIGN PATENT DOCUMENTS

| | | |
|---|---|---|
| EP | 0 747 292 A1 | 12/1996 |
| FR | 2 756 899 | 6/1998 |
| WO | WO 01/25116 A1 | 4/2001 |

* cited by examiner

*Primary Examiner*—Lien T Ngo
(74) *Attorney, Agent, or Firm*—Pillsbury Winthrop Shaw Pittman, LLP

(57) ABSTRACT

A nozzle arrangement adapted to be fitted to a pressurized vessel and to permit fluid to be dispensed through it under pressure, is presented. The nozzle arrangement includes a body having an inlet, an outlet, an internal fluid flow passageway through which fluid can flow from the inlet to the outlet, and an actuator portion adapted, upon operation, to engage and open an outlet valve of the pressurized vessel. The nozzle arrangement further includes a resiliently deformable wall member that undergoes a resilient deformation from an initial resiliently-biased configuration to a distended configuration in response to the operation of the actuator portion, and to revert to the initial resiliently-biased configuration when the operation of the actuator portion has ceased and cause any fluid remaining in the passageway to be expelled.

30 Claims, 8 Drawing Sheets

OUTLET DEVICE FOR A CONTAINER OR VESSEL

BACKGROUND OF THE INVENTION

1. Related Applications

This is the U.S. National Stage application of International Application No. PCT/GB2003/003762, filed Aug. 22, 2003, which relies for priority upon British Application No. 0219641.8, filed Aug. 23, 2002; British Application No. 0226867.0, filed Nov. 19, 2002; British Application No. 0303698.5, filed Feb. 18, 2003; British Application No. 0305597.7, filed Mar. 12, 2003; British Application No. 0308909.1, filed Apr. 17, 2003; and British Application No. 0310244.9, filed on May 3, 2003, the contents of all of which are incorporated herein by reference in their entireties.

2. Field of the Invention

This invention relates to an outlet device for a container or vessel. More particularly, but not exclusively, this invention relates to improved nozzle arrangements that are adapted to be fitted to an outlet of a container or vessel.

3. Related Applications

Nozzle arrangements are commonly used to facilitate the dispensing of various fluids from containers or vessels. For instance, nozzle arrangements are commonly fitted to pressurised fluid-filled vessels or containers, such as a so-called "aerosol canister", to provide a means by which fluid stored in the vessel or container can be dispensed. In addition, so-called pump and trigger-activated nozzle arrangements are also commonly used to enable the fluid contents of a non-pressurised vessel or container to be conveniently dispensed in response to the operation of the pump or trigger by an operator.

A typical nozzle arrangement comprises an inlet through which fluid accesses the nozzle arrangement, an outlet through which the fluid is dispensed into the external environment, and an internal fluid flow passageway through which fluid can flow from the inlet to the outlet. In addition, conventional nozzle arrangements comprise an actuator means, such as, for example, a manually operable pump or trigger. The operation of the actuator means causes fluid to flow from the container to which the arrangement is attached into the inlet of the arrangement, where it then flows along the fluid flow passageway to the outlet. After each use, it is usual for a proportion of the fluid from the container to remain within the nozzle arrangement. This can cause a number of problems. Firstly, the fluid product retained in the nozzle arrangement after use may dry out or harden and can result in a build up of residue within the passageway, which may ultimately lead to the blockage of the inlet, the outlet or the internal passageway. This can be a particularly problematical with certain fluid products such as, for example, a food product (such as cream, sauces etc.), a cosmetic or pharmaceutical cream or lotion, or an expandable product such as hair mousse, shaving foam etc. Secondly, there is also a tendency for certain fluid products that remain in the passageway to leak out of through the outlet of the nozzle arrangement over time. Leakage is especially prevalent when the fluid product being dispensed is an "expandable product", such as, for example, shaving foam or hair mousse, because the proportion of the product remaining in the nozzle arrangement after use typically expands over time and this invariably causes a proportion of the fluid to leak out through the outlet. Alternatively, this leakage may simply occur as a result of gravity causing fluid to flow towards the outlet after use. Any fluid that does leak through the outlet over time can become adhered to the outlet or the surrounding vicinity creating a mess. The leaked fluid may also run down the side of the container or onto the surface on which the container is placed. A third problem is that fluid remaining in the nozzle arrangement, or which leaks out of the nozzle arrangement over time, may degrade or become contaminates with microbes.

One approach to solve this problem is to provide a cleanable nozzle arrangement. Examples of such nozzle arrangements are described in International Patent Publication Numbers WO 97/31841 and WO 01/89958. The nozzle arrangements disclosed in WO 97/31841 and WO 01/89958 are formed from two constituent parts, which can be split apart to enable the inside of the arrangement, particularly the fluid flow passageway and the outlet orifice, to be accessed for cleaning. Hence, any fluid product remaining in the nozzle arrangement after use or residue that has built up can be removed. However, it is neither practicable nor convenient to clean the nozzle arrangement after each use. For this reason, there is a desire to seek alternative approaches to alleviate this problem.

It is an object of the present invention to provide a nozzle arrangement in which some or all of the aforementioned problems that are caused by fluid remaining in the nozzle arrangement after use are solved, or at least minimised.

SUMMARY OF THE INVENTION

According to a first aspect of the present invention there is provided a nozzle arrangement adapted to be fitted to a pressurised vessel or container and to permit fluid present in said vessel or container to be dispensed through it under pressure, said nozzle arrangement having a body which defines an inlet, an outlet, and an internal fluid flow passageway through which fluid can flow from said inlet to said outlet, said body comprising actuator means which is adapted, upon operation, to engage and open an outlet valve of the pressurised vessel or container to which the arrangement is attached and thereby enable fluid present in the pressurised vessel or container to be released into the inlet of said arrangement, wherein the body of the nozzle arrangement comprises a resiliently deformable wall member which defines at least a portion of the fluid flow passageway, said resiliently deformable wall and being configured such that, when fluid is caused to flow through the nozzle arrangement in response to the operation of said actuator means, said wall undergoes a resilient deformation from an initial resiliently-biased configuration in which said portion of the passageway is closed to a distended configuration whereby fluid can flow through said portion of the passageway and be dispensed through the outlet, said wall being further configured to revert to the initial resiliently-biased configuration when the operation of the actuator means is ceased and thereby cause any fluid remaining in said portion of the passageway to be expelled.

The nozzle arrangements of the present invention have been found to solve the aforementioned problems associated with fluid remaining within the internal fluid flow passageway after use. Specifically, the provision of a nozzle arrangement as defined above has been found to provide a means by which any fluid remaining within the fluid flow passageway is expelled from the nozzle arrangement after each operation of the actuation means. In practice, this occurs as soon as the actuation of the release of the contents of the vessel or container has finished and is hardly noticeable to the operator.

In order to ensure that no product is retained in the vicinity of the outlet, it is preferred that the portion of the passageway defined by a resiliently deformable wall is disposed adjacent (i.e. immediately adjacent) to the outlet opening. It is especially preferred that said portion internal fluid flow passageway adjoins the outlet.

In the resiliently biased configuration, the portion of fluid flow passageway is preferably closed along its whole length.

It is also preferable that the resiliently deformable wall (or the internal surface of the passageway formed thereby) extends for substantially the entire length, of the internal fluid flow passageway, thereby enabling all, or substantially all, of the fluid remaining in the fluid flow passageway to be expelled once the operation of the actuation means ceases and the resiliently deformable wall reverts to its initial resiliently-biased configuration. By "substantially the entire length [of the internal fluid flow passageway]" we mean that the resiliently deformable wall (and the internal surface of the passageway formed thereby) extends for 75% or more of the length of the fluid flow passageway or, more preferably, 90% or more of the length of the fluid flow passageway, or, even more preferably, 98% or more of the length of the fluid flow passageway. It is most preferred that the resiliently deformable wall extends the entire length of the fluid flow passageway.

Preferably, the outlet is defined, at least in part, by a resiliently deformable wall of the body, which is configured such that, when fluid is caused to flow through the nozzle arrangement in response to the operation of said actuator means, said wall undergoes a resilient deformation from an initial resiliently-biased configuration in which the outlet is closed to a distended configuration whereby fluid can flow through said outlet, said wall being further configured to revert to the initial resiliently-biased configuration when the operation of the actuator means ceases and thereby causing any fluid remaining in said outlet to be expelled.

It is especially preferred that the outlet is an open end of said portion of the passageway (i.e. the resiliently deformable wall which defines the outlet is the end of the resiliently deformable wall which defines said portion of the fluid flow passageway).

The provision of the portion of the passageway defined by a resiliently deformable wall that extends up to or adjoins the outlet, as well as the provision of a resiliently deformable outlet, enables substantially all of the fluid remaining in the vicinity of the outlet to be expelled and thus, prevents any subsequent leakage occurring.

The elasticity/resilience of the resiliently deformable wall may be uniform or, alternatively, it may vary along the length of said portion of the internal passageway. Preferably, the resiliently deformable wall which defines an internal surface of the fluid flow passageway is adapted such that, when the operation of the actuator has ceased and the resiliently deformable wall reverts to the initial resiliently-biased configuration, any fluid remaining in said portion of the passageway is expelled through the outlet (although a small proportion of fluid may be pushed back towards the container once the operation of the actuator means has ceased, it is preferable that the all, or substantially all, is expelled through the outlet). It is most preferred that the fluid remaining in the passageway is caused to flow out of the passageway and through the outlet in a continuous flow, so that as soon as the actuation is ceased there has only a short lag time while fluid which would otherwise remain in the passageway continues to be dispensed through the outlet. In order to achieve this objective, it is preferable that the resilience of the resiliently deformable wall varies along the length of the portion of the internal passageway. In certain embodiments of the invention, this may be achieved by varying the thickness of the resiliently deformable wall. It is particularly preferred that the resilience or elasticity of the resiliently deformable wall is greater at locations disposed from the outlet than at positions proximate to said outlet, so that, when the operation of the actuator is ceased, the resiliently deformable wall reverts to the initial resiliently-biased configuration preferentially at positions further way from the outlet. This causes any fluid remaining in the passageway to be gradually forced out towards the outlet where it is dispensed into the external environment. In preferred embodiments where the resiliently deformable wall extends for all or substantially all of the length of the passageway, the resiliently deformable wall reverts to the initial resiliently biased configuration preferentially at positions proximate to the inlet so that all or virtually all of the fluid remaining in the internal passageway proximate to the inlet is forced to flow towards, and be expelled though, the outlet. It is most preferred that the resilience or elasticity of the resilient deformable wall increases proportionally with increasing distance from the outlet. Again, this can be achieved in certain embodiments of the invention by tapering the thickness of the resiliently deformable wall towards the outlet. The net effect of the aforementioned configurations of the resiliently deformable wall is that the last portion of fluid dispensed through the outlet when the operation of the actuation means has ceased is the portion that would otherwise remain in the internal passageway of a conventional nozzle arrangement.

Preferably, the resiliently deformable wall possesses a uniform resilience across the width of the fluid flow passageway to minimise any lateral displacement of fluid.

It shall be appreciated that the resiliently deformable wall forms an internal surface of the fluid flow passageway. The fluid flow passageway may comprise one or more internal surfaces defined by one or more internal walls. For instance, the internal fluid flow passageway may be entirely defined by the resiliently deformable wall (or, in other words, the internal surface of the resiliently deformable wall may form the entire internal surface of the passageway). Alternatively, there may be two or more walls which define the internal fluid flow passageway, each wall forming an internal surface of the passageway and at least one of which is resiliently deformable. In the resiliently biased configuration, the at least one resiliently deformable wall is resiliently biased against the opposing walls to define a closed passageway.

When the actuator is operated and fluid is caused to flow through the device under pressure, the surface of the passageway formed by the at least one resiliently deformable wall is configured to deform away from the opposing surface as the resiliently deformable wall becomes distended and thereby defines an open channel or passageway through which the fluid can flow to the outlet. Once the operation of the actuation means ceases and the at least one resiliently deformable wall reverts to its resiliently biased configuration, any fluid that remains in the passageway is expelled.

Preferably, said portion of the fluid follow passageway is defined by two walls.

In a preferred embodiment, only one of the walls is resiliently deformable, said resiliently deformable wall being resiliently biased against the opposing non-deformable wall.

In a preferred embodiment of the invention, the body of the nozzle arrangement is formed from two interconnected parts, each of said parts having an abutment surface. The abutment surfaces of the two parts are contacted together in the assembled nozzle arrangement and portions of said abutment surfaces form the walls which define internal fluid flow passageway. Examples of such nozzle arrangements of this construction are described in International Patent Publication Numbers WO 97/31841 and WO 01/89958, the entire contents of which are incorporated herein by reference.

In the preferred embodiments of the present invention, at least one of the abutment surfaces, or the portion thereof which forms the wall of the internal fluid flow passageway, is resiliently deformable.

It is especially preferred that a first of said abutment surfaces is non-deformable and comprises a groove formed in its abutment surface, which extends from an inlet defined by the body to an edge of the abutment surface. This groove forms a first wall of the fluid flow passageway. The second opposing abutment surface comprises a corresponding resiliently deformable ridge member which, when the two abutment surfaces are contacted together, is received within said groove and is resiliently biased so that the surfaces of the ridge and groove are in tight abutment with one another. It is preferable that no gaps are present between the surface of the ridge of the second abutment surface and the groove of the first abutment surface and that the ridge extends along the entire length of the groove. The groove and the ridge together form the walls which define the internal fluid flow passageway and, in preferred embodiments, the terminus of fluid flow passageway at the edge of abutment surfaces defines the outlet.

The portions of the abutment surfaces of the two parts which form the walls of the internal passageway when the respective parts are connected together may be flat or of any other suitable form instead of the ridge and groove arrangement discussed above.

Preferably, the fluid flow passageway is entirely defined by the walls formed by the abutment surfaces of the two parts of the body.

It is also preferable that the distance through which the fluid has to flow through the inlet of the device in order to access the fluid flow passageway is minimal so as to reduce the likelihood of fluid remaining within the inlet once the operation of the actuation means ceases. This can be achieved by configuring the nozzle arrangement such that the inlet through which fluid accesses the fluid flow passageway during use is disposed directly adjacent to the outlet valve of the pressurised fluid filled vessel or container to which it is adapted to be attached so that fluid dispensed through the outlet valve flows a minimal distance before entering the fluid flow passageway. If the fluid does have to flow through the inlet for any distance (i.e. the inlet is effectively an initial length of the fluid flow passageway), then it is preferable that the inlet is also configured in the same way as the fluid flow passageway defined above so that any fluid that remains therein once the operation of the actuation means ceases is caused to flow out of the inlet, along the fluid flow passageway and be dispensed through the outlet.

The two parts may be separable from one another so as to enable the internal fluid flow passageway to be periodically exposed for cleaning. In this regard, although the necessity for cleaning is reduced because the amount of product retained in the internal passageway will be virtually negligible (especially in preferred embodiments), it is possible that some residue may build up over prolonged periods of time, so it may still be desirable to be able to clean the internal passageway periodically to prevent any such build up of residue occurring. Alternatively, the two parts may be permanently fixed together.

In preferred embodiments of the invention, the first part of the nozzle arrangement will be a lower or base part, which is adapted to fit onto the container and defines the inlet and the first abutment surface, a portion of which forms a wall of the internal fluid flow passageway and the outlet. The second part is an upper part or lid which is fitted onto the base part. The lid or upper part may be small, i.e. just covering the top of the internal passageway or may be large so as to cover all or the majority of the upper surface of the lower part. In the latter case, a large lid formed from a resiliently deformable material would give a softer feel to a user handling the nozzle arrangement.

Preferably, the abutment surfaces of the first and second parts additionally comprise a seal, which extends around the internal passageway defined by the abutment surfaces as well as the outlet and the inlet opening through which fluid is introduced to the fluid flow passageway. A suitable seal is described further in International Patent Publication Numbers WO 97/31841 and WO 01/89958 the entire contents of which are incorporated herein by reference. Briefly, the seal is composed of a female channel formed on one abutment surface which receives a male ridge formed on the opposing abutment surface to form a sealing engagement when the abutment surfaces are contacted together. The seal prevents any fluid that has leaked out of the fluid flow passageway, the inlet or the outlet from seeping between the abutment surfaces and leaking out of the side of the nozzle arrangement.

A seal may also be provided across the internal fluid flow passageway to provide a substantially airtight seal when the nozzle arrangement is not in use and the portion of the passageway is closed. Preferably, the seal consists of a groove formed on the resiliently deformable wall and extending across the width of the internal fluid flow passageway, said groove being adapted to receive, and form a sealing engagement with, a ridge member formed on an opposing wall when said resiliently deformable wall is in its initial resiliently biased configuration, or vice versa (i.e. the groove and ridge being reversed). Preferably, the seal is disposed proximate to the outlet. The provision of a seal is particularly advantageous if the product passing through the nozzle is one that is prone to degradation by air (such as creams or other food products) or products with a more watery consistency or which tend to form film coatings on surfaces, such as soaps or washing up liquids. The seal extending across the fluid flow passageway may be formed as an extension of the sealing means which encircles the passageway, the inlet and the outlet, discussed above.

As stated above, the parts forming the body of the nozzle arrangement may be completely separable. In such cases, the parts may be clipped together to hold them in position. The clipping means may comprise one or more male projections provided on the abutment surface of one of said parts, which are received within correspondingly shaped female holes or sockets provided in the other part.

Alternatively, the respective parts may be connected to one another by a hinged connector which enables the abutment surfaces of the two parts to be brought together for use as a nozzle arrangement, but separated and swung apart for cleaning when desired. In such embodiments, a clip or an alternative securing means may also be provided to retain the parts together, during use.

In some embodiments the two-parts of the nozzle arrangement may be permanently welded together to provide a single unitary structure. This can be achieved if the rigid plastic of the first part is formed of the same or similar material to the second part. The weld may be formed by the application of heat, or an ultrasonic welding process.

In the preferred embodiments of the invention described above where the nozzle arrangement is made from two component parts, it is especially preferred that one of said parts (the first part) of the nozzle arrangement is formed from a rigid moulded plastic material, such as, for example, polypropylene, whereas the other of said parts (the second part) is formed from a resiliently deformable material. Any suitable resiliently deformable material, such as a resiliently deformable plastic, rubber, or soft flexible plastic materials, such as flexible polypropylene or flexible polyethylene, may be used.

In addition, the term "resiliently deformable wall" is also used herein to encompass a wall made from a rigid plastic material, which is configured in such a way that a resilient deformation may still occur when a pressure is applied (i.e. when the pressure is removed, the material will then return to its original configuration). For example, the entire nozzle arrangement, or just the resiliently deformable wall, may be moulded from a single so-called rigid/flexible plastic material. By "rigid/flexible" we mean a plastic material which is essentially rigid, but which can be caused to deform in response to the application of pressure. The rigidity/flexibility is usually dictated by the material itself and thickness of the section of the material. A person skilled in the art would appreciate how to manufacture the nozzle arrangement form such materials.

As an alternative, the nozzle arrangement could be moulded from a single rigid plastic material. In such cases, instead of forming the resiliently deformable wall which defines the passageway from a resiliently deformable material, it may be formed from the rigid material provided the wall is configured in such a way that it can still resiliently deform from an initial resiliently-biased configuration to a distended configuration as defined above. For example, the rigid plastic forming the resiliently deformable wall could be very thin so that it exhibits some inherent resilient deformability or, alternatively, the wall may remain rigid and be resiliently mounted within the arrangement.

The two parts may be moulded separately and then connected together or, more preferably, may be moulded as a bi-moulding (a two-part or two-stage moulding) in one machine. In the latter case, a first part of the nozzle arrangement is formed in a first stage and the second part is then moulded onto the first part in a second stage. In preferred embodiments where the first part is made from a rigid plastic and the second part is made from a resiliently deformable material, the second part is preferably moulded directly onto the first part. This ensures a tight contact between the resiliently deformable wall of the second part and the opposing wall of the first part. Preferably, one or more holes are formed on the abutment surface of the first part through which the resiliently deformable material injected into the mould to form the second part can flow. A space is preferably present on the opposing sides of the one or more holes, which the fluid resiliently deformable material will flow into and fill it so that when the material hardens, the second part becomes effectively riveted to the first part. This is preferred because it can otherwise be difficult to adequately secure the second first parts together. Preferably, the first part comprises a groove which forms part of the seal encircling the inlet, the fluid flow passageway and the outlet, as discussed above, and the one or more holes are provided in the bottom of this groove so that the resiliently deformable rivets formed though said one or more holes are connected to the ridge element of the seal formed on the abutment surface of the second part.

The entire second part of the nozzle arrangement may be formed of the same material or, alternatively, may be formed from one or more different materials. For example, a portion of the second part may be formed from a rigid material, such as a rigid moulded plastic (e.g. polypropylene), and the resiliently deformable wall of the passageway may be formed from a section of resiliently deformable material which is inserted into, and retained within, the second part.

The internal passageway may be of any suitable shape or configuration for the required purpose. In most cases it will be straight, but it could be curved, shaped or split into one or more internal channels. For example, in certain embodiments of the invention the fluid flow passageway may be the surface of a body or member which is provided with a resiliently deformable cover or sheath, said cover or sheath being resiliently biased against the surface of said member and forming the resiliently deformable wall of the passageway. During use, fluid is introduced onto the surface of said member though an inlet and the pressure of the fluid causes the resiliently deformable cover to distend away from the surface of the member to define a channel though which fluid can flow to an outlet.

If the product is intended to be ejected from the nozzle arrangement in the form of a spray, the internal passageway may additionally comprise one or more internal spray modifying structures, such as, for example, one or more expansion chambers, inner orifices, venturi chambers, or swirl chambers. The effect of such internal spray modifying structures is described further in International Patent Publication No. WO 01/89958, which, as stated above, is incorporated herein by reference.

If the product dispensed through the nozzle is a viscous liquid or foam, then the internal passageway could be made wider in the vicinity of the outlet to dispense the product in thicker portions (typically referred to as "slugs").

Certain nozzle arrangements currently available are provided with a mesh positioned at or near the outlet. In such nozzle arrangements, the mesh could be formed from hardened material as usual and the resiliently deformable wall could extend right up to the mesh or, alternatively, the mesh could be made of resiliently deformable material by, for example, being moulded integrally with the second or upper part.

The nozzle arrangement of the present invention may be any suitable form of nozzle arrangement. Preferably, however, the nozzle arrangement is in the form of a spray-through cap, which is adapted to be fitted to a hand-held, pressurised aerosol canister. Examples of spray-through cap nozzle arrangements are again described in International Patent Publication No.'s WO 97/31841 and WO 01/89958. The nozzle arrangement may be fitted to the pressurised container by any suitable means, such a, for example, by a screw-threaded connection or a snap-fit mechanism.

The actuator means may be any means that can be operated to selectively open the outlet valve of the pressurised container or vessel. Preferably, the actuator means is a portion of the nozzle arrangement that can be depressed by an operator so as to engage and open the outlet valve. Such actuator means are well known in the art.

The objective of the preferred embodiments of the present invention is to ensure that virtually all of the fluid remaining in the fluid flow passageway is expelled after use. However, in some less preferred embodiments where the entire fluid flow passageway is not defined by the resiliently deformable wall, any fluid remaining is less likely to degrade or become contaminated because the closure of the passageway cuts of the outlet and effectively creates a substantially air tight seal. Furthermore, any expandable products remaining in the passageway in such embodiments can be kept away from the outlet so as to minimise the risk of any leakage occurring.

According to a second aspect of the present invention, there is provided a pressurised vessel or container having an outlet valve and a nozzle arrangement as defined above fitted thereto.

The operation of the actuator means of the nozzle arrangement causes the outlet valve to open and fluid stored in the vessel or container to be dispensed through the nozzle arrangement.

It shall be appreciated that the terms "pressurised vessel" and "pressurised container" are used herein to denote any suitable pressurised vessels or container. In most cases, the container will be a hand-held, pressurised aerosol canister, although the invention is not to be construed as being limited to just these containers.

The present invention also applies to an outlet device for a non-pressurised container. Thus, in a further aspect, the present invention provides an outlet device adapted to be fitted to a non-pressurised vessel or container and to permit fluid present in said vessel or container to be dispensed through it under pressure, said outlet device having a body which defines an inlet, an outlet and an internal fluid flow passageway through which fluid can flow from said inlet to said outlet under pressure;

wherein the body of the nozzle arrangement comprises a resiliently deformable wall that forms an internal surface of the fluid flow passageway which extends for substantially the entire length of the fluid flow passageway, said resiliently deformable wall and being configured such that, when fluid is caused to flow through the outlet device under pressure, said wall undergoes a resilient deformation from an initial resiliently-biased configuration in which the substantially entire length of said passageway is closed to a distended configuration whereby fluid can flow through said portion of the passageway and be dispensed through the outlet, said wall being further configured to revert to the initial resiliently-biased configuration when the operation of the actuator means is ceased and thereby cause any fluid remaining in said passageway to be expelled.

The outlet device defined above may be fitted to any suitable non-pressurised container. However, the term "container" used herein also includes less conventional containers in which the contents to be dispensed may be stored, such as a pipe (e.g. a garden hosepipe), or any other shaped article having an outlet which may contain the contents to be dispensed through the outlet device or nozzle arrangement.

As above, by "substantially the entire length [of the fluid flow passageway]" we mean that the resiliently deformable wall (and the internal surface of the passageway formed thereby) extends for 75% or more of the length of the fluid flow passageway or, preferably, 90% or more of the length of the fluid flow passageway, or, even more preferably, 98% or more of the length of the fluid flow passageway.

It is most preferable, however, that the resiliently deformable wall (or the internal surface of the passageway formed thereby) extends for the entire length of the internal fluid flow passageway, thereby enabling all, or substantially all, of the fluid remaining in the fluid flow passageway to be expelled once the operation of the actuation means and the resiliently deformable wall reverts to its initial resiliently-biased configuration.

Furthermore, the fluid may be caused to flow through the outlet device under pressure by any suitable means. In a preferred embodiment of the invention, the outlet device is a pump or trigger-actuated nozzle arrangement and the fluid is caused to flow through the nozzle arrangement under pressure when the pump or trigger actuator is operated. Such pump or trigger-actuated nozzle arrangements typically comprise (i) an internal compressible chamber; (ii) an inlet through which fluid is drawn from said vessel or container into said compressible chamber; (iii) an outlet; (iv) an internal fluid flow passageway which connects said chamber to said outlet; and, finally, (v) a pump or trigger actuator, the operation of which causes fluid present in the chamber to flow though the internal fluid flow passageway and out of said outlet under pressure. These nozzle arrangements are well known in the art.

Other features of the resiliently deformable, the internal fluid flow passageway, the inlet and the outlet of the outlet device are as defined above in reference to the first aspect of the present invention.

The outlet device may also be formed from any of the materials and methods outlined above.

According to yet another aspect of the invention there is provided a non-pressurised vessel or container having an outlet, said outlet having an outlet device as hereinbefore defined fitted thereto.

BRIEF DESCRIPTION OF THE DRAWINGS

How the invention may be put into practice will now be described by way of example only, in reference to the following drawings, in which.

In the following description of the figures, like reference numerals are used to denote like parts in different figures, where appropriate.

DETAILED DESCRIPTION

Figure 1:
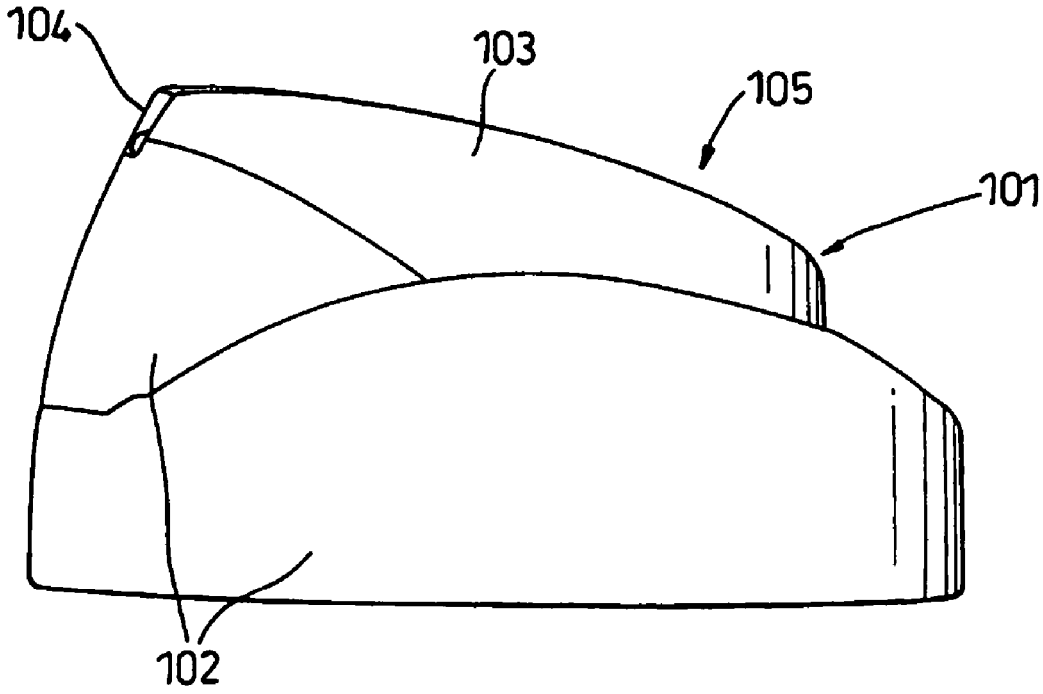
FIG. 1 is a diagrammatic illustration showing a side view of a spray-through cap nozzle arrangement according to the present invention.

Referring to FIG. 1, a two-part spray-through cap nozzle arrangement 101 is shown which is adapted to be fitted to the end of a standard cylindrical aerosol canister (not shown). The spray-through cap nozzle arrangement 101 has a lower part 102 and an upper part 103. An outlet 104 is formed at the edge of the interface between the lower part 102 and the upper part 103.

Figure 2A:
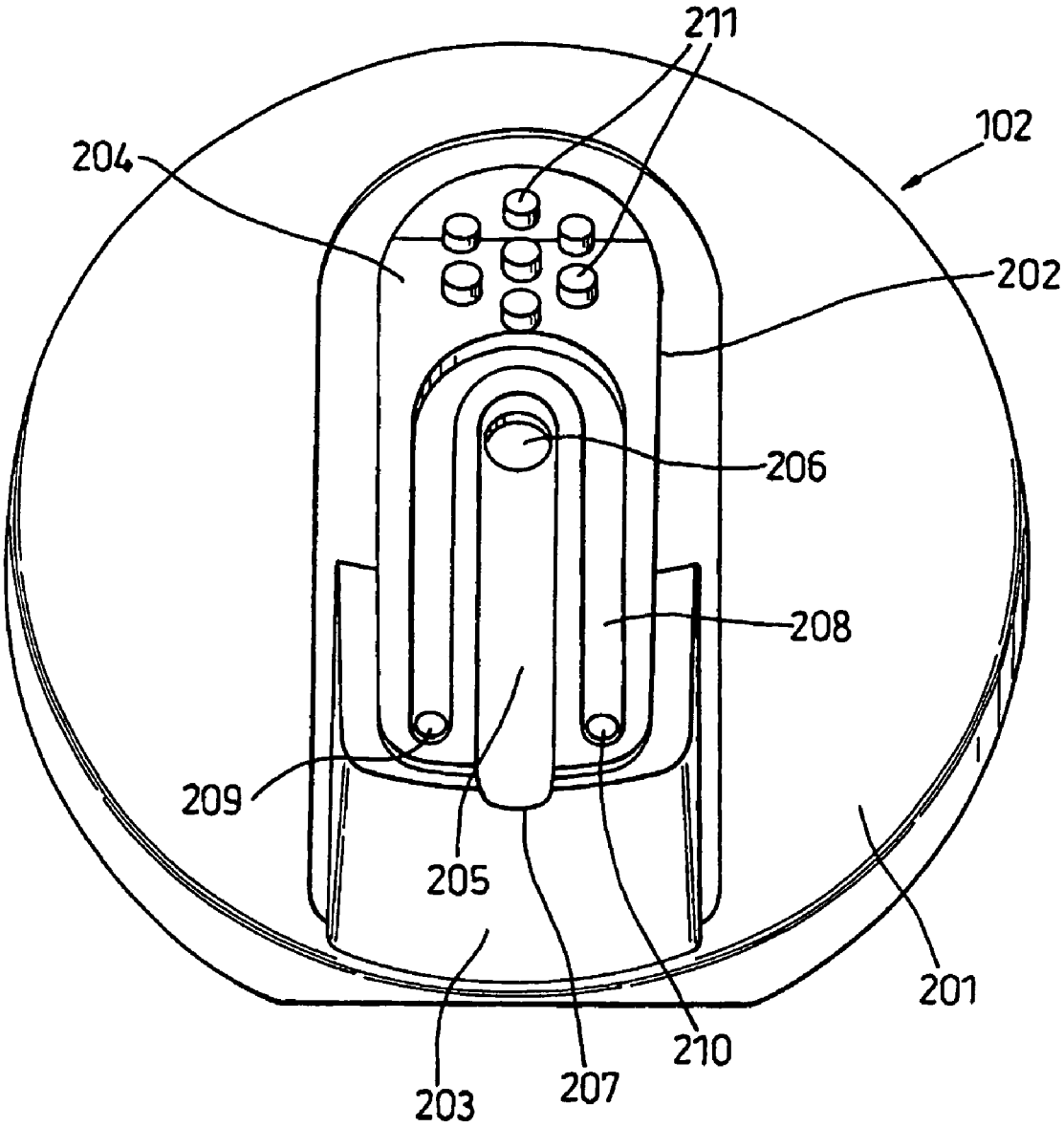
FIG. 2A is a diagrammatic illustration showing a perspective view of the lower part 102 of the spray-through cap nozzle arrangement shown in FIG. 1.
Figure 2B:
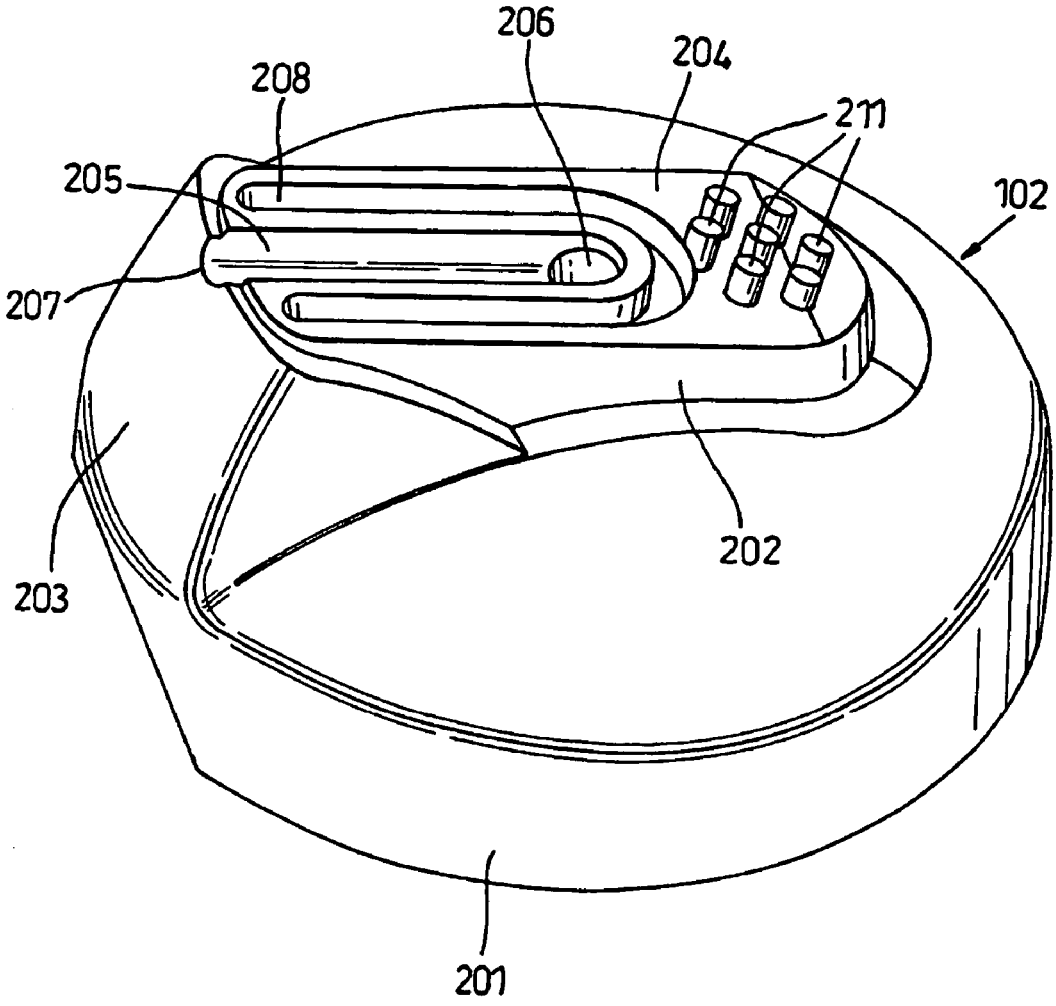
FIG. 2B is a further diagrammatic illustration showing a perspective view of the lower part 102 of the spray-through cap nozzle arrangement shown in FIG. 1.
Figure 2C:
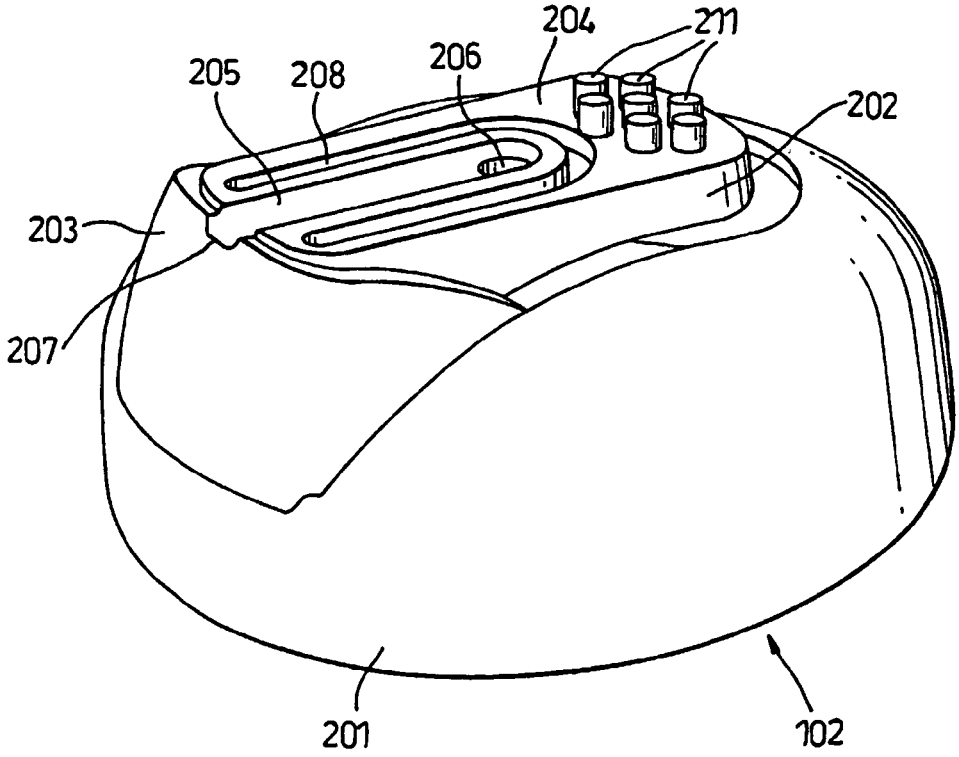
FIG. 2C is a line diagram showing the perspective view of the lower part 102 of the spray-through cap nozzle arrangement shown in FIG. 2B.
Figure 2D:
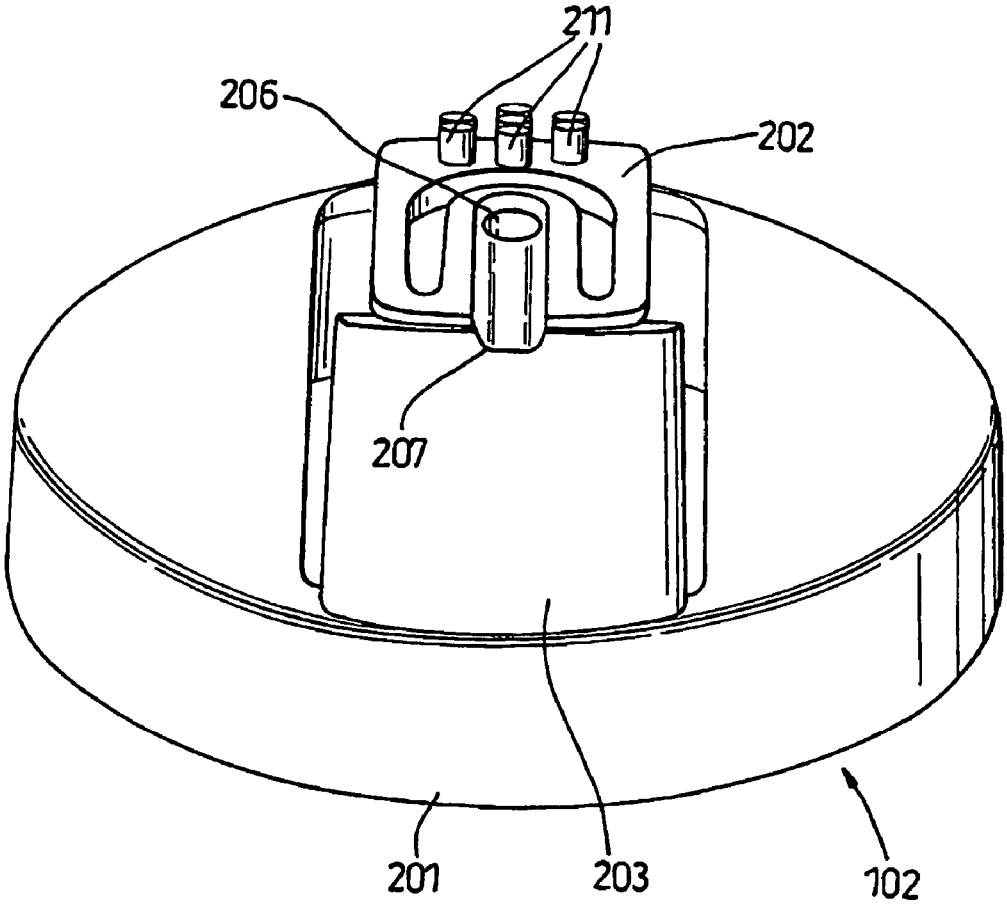
FIG. 2D is a further diagrammatic illustration showing a perspective view of the lower part 102 of the spray-through cap nozzle arrangement shown in FIG. 1.

To actuate the release of fluid from the outlet valve of the aerosol canister (not shown) and thereby cause fluid to be dispensed through the nozzle arrangement, the upper part 103 is pressed downwards in the direction of arrow 105 by an operator. This causes the lower part 102 of the nozzle arrangement to engage and open the valve, as discussed further below in reference to FIGS. 2A through to 2D.

Referring to FIGS. 2A, 2B, 2C and 2D, the lower part 102 has circular shaped base 201 which is configured to be fitted to the end of the standard cylindrical aerosol canister (not shown). The lower part 102 additionally comprises a centrally positioned actuator portion 202, which is connected to the base 201 by a connection portion 203. The connection portion 203 is resiliently deformable so as to permit the actuator portion 202 to be pressed downwards relative to the base 201 and subsequently spring back to its initial position when the downward pressure applied by the operator is released. The lower surface of actuator portion 202 releasably engages with the outlet valve of the aerosol canister when the actuator portion 202 is pressed downwards in the direction of arrow 105 (as shown in FIG. 1). Depressing the actuator portion in this manner causes the valve to open and permits the fluid present in the container to be released through the nozzle arrangement 101.

The upper surface of the actuator portion 202 forms the abutment surface 204 of the lower part. Formed on the abutment surface 204 is a groove 205, which extends from an inlet opening 206 to the edge of the abutment surface 207. The inlet opening 206 is aligned with the top of the outlet valve of the aerosol canister and forms the inlet of the nozzle arrangement 101 through which fluid released from the aerosol canister accesses the nozzle arrangement 101 during use. As stated above, the lower surface of the actuator part 203 is configured to engage the outlet valve of an aerosol canister and this means that the volume of the inlet is minimal (i.e. there is no significant downwardly extending channel through in which fluid may remain once the actuation of the release of fluid from the outlet valve of the canister ceases). The groove 205 forms a wall of the body, which defines an internal surface of the fluid flow passageway and the end of the groove at the edge 207 forms part of the outlet 104 of the nozzle arrangement 101. Also present on the abutment surface 204 is a horseshoe-shaped recess 208, which encircles the inlet opening 206 and the groove 205. This horseshoe-shaped recess forms part of a horseshoe shaped seal in the nozzle arrangement 101, as explained further below in reference to FIG. 3A. At the two ends of the horseshoe shape recess 208 are two holes 209 and 210. Alignment projections 211 are also formed on the abutment surface 204 of the lower part 102. The significance of the two holes 209 and 210 and the alignment projections 211 will be explained further below in reference to FIGS. 3A, 3B and 3C.

Figure 3A:
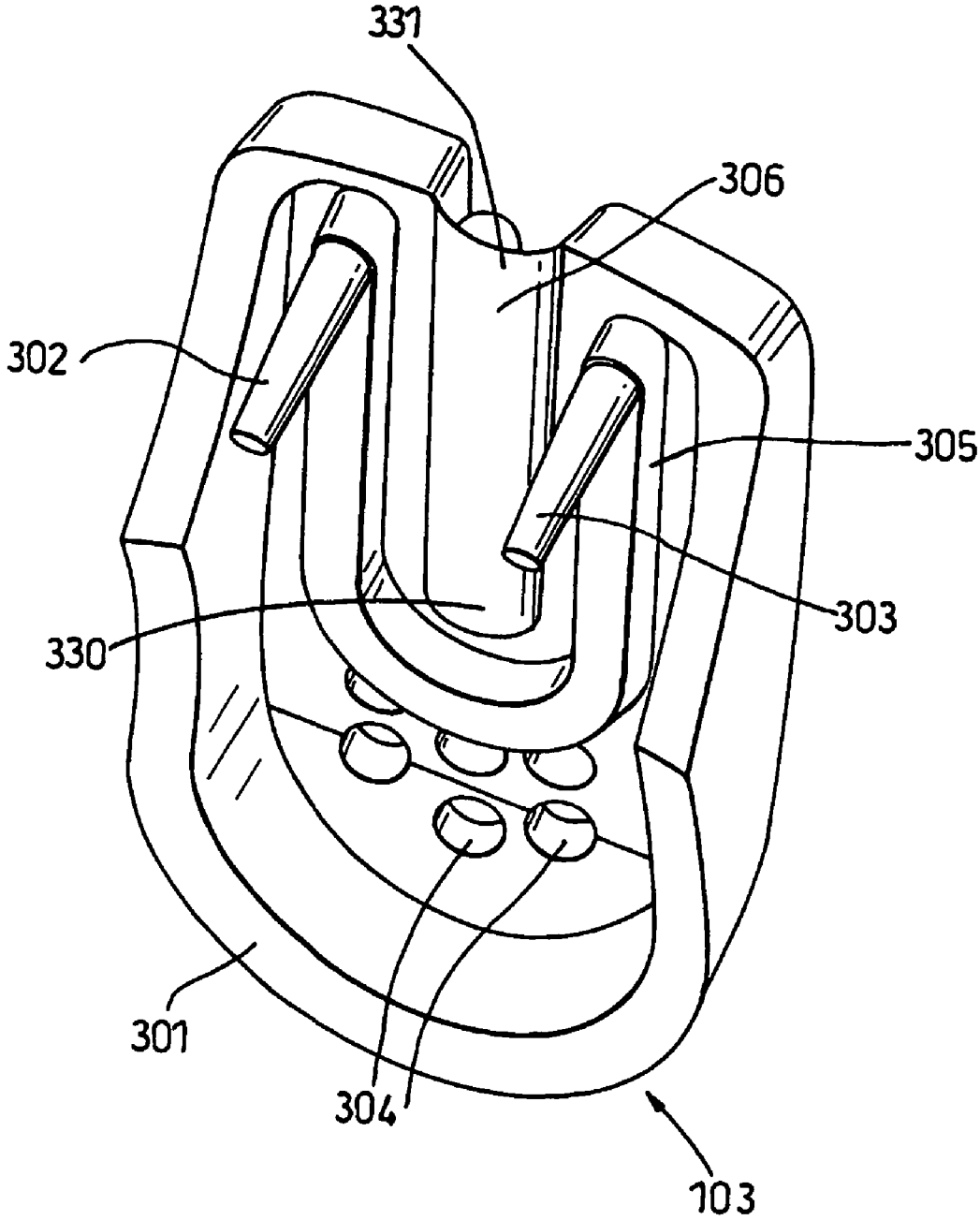
FIG. 3A is diagrammatic illustration showing a perspective view of the upper part 103 of the nozzle arrangement shown in FIG. 1.
Figure 3B:
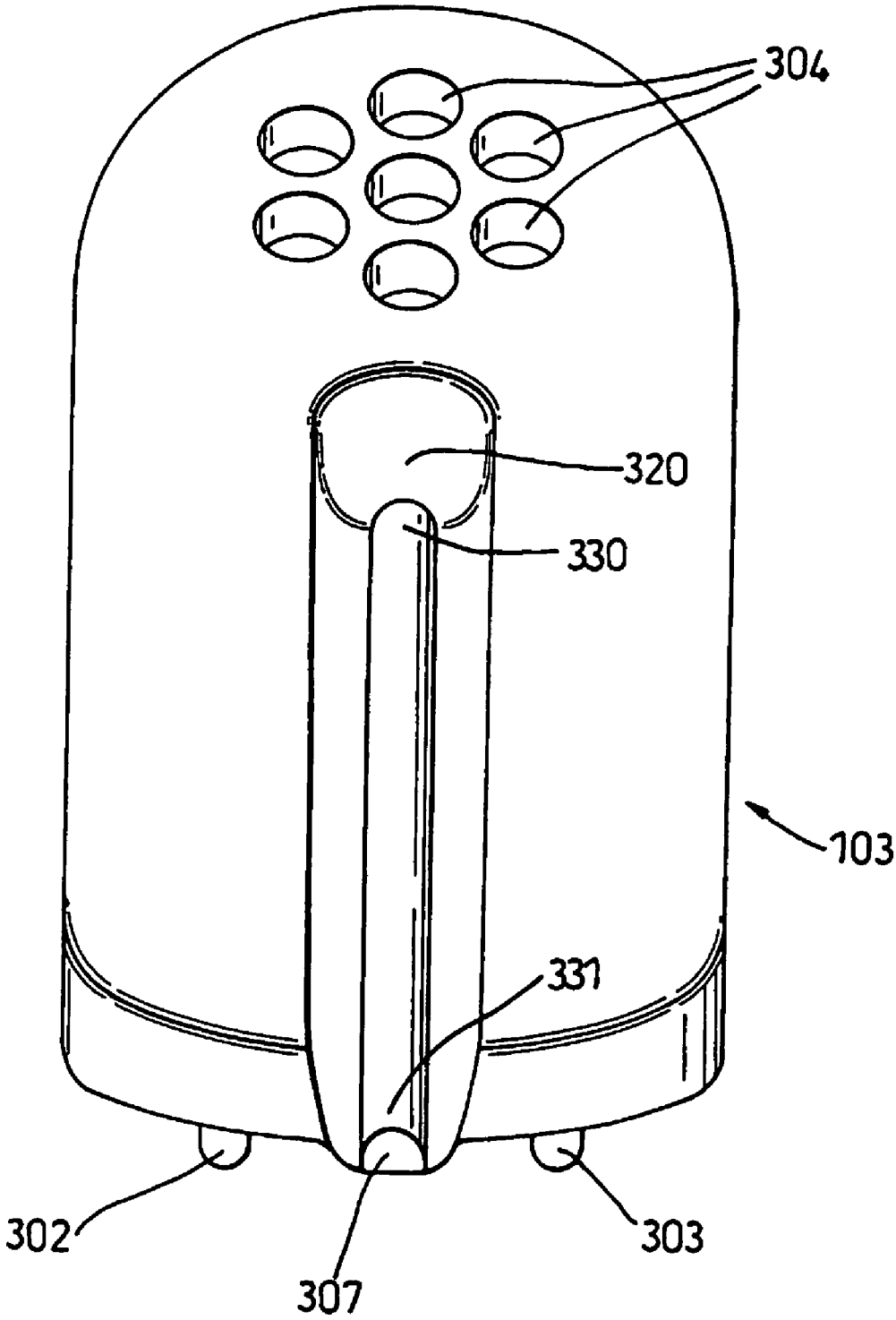
FIG. 3B is a diagrammatic illustration showing a perspective view of the upper part 103 of the nozzle arrangement shown in FIG. 1.
Figure 3C:
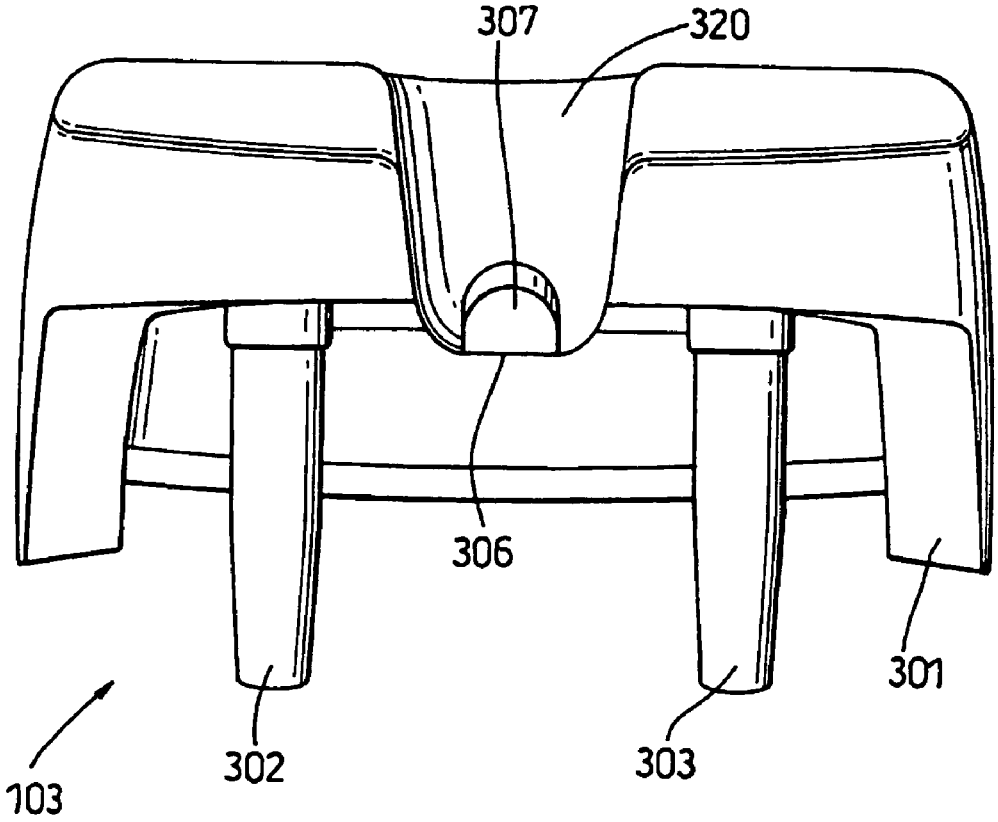
FIG. 3C is an end view of the upper part 103 of the nozzle arrangement shown in FIG. 1.

The upper part 103 of the nozzle arrangement 101 is shown in more detail in FIGS. 3A, 3B and 3C. Referring to FIG. 3A, the upper part 103 has an abutment surface 305, which contacts the abutment surface 204 of the lower part 102 to form the final nozzle arrangement 101. To enable the upper part 103 to align with the lower part 102 so that the abutment surface 305 abuts the abutment surface 204, the upper part 103 is provided with a wall 301, which is configured to fit around the edge of the actuator part 202 of the lower part 103. The appropriate alignment is further assisted by the protrusion rods 302 and 303 which, when the abutment surfaces are brought into contact, are received within the holes 209 and 210 of the lower part respectively, while the holes 304 of the upper part 103 receive the protrusions 211 provided on the abutment surface 204.

The abutment surface 305 of the upper part 103 is provided with a ridge 306, which is resiliently biased in the configuration shown in FIGS. 3A, 3B and 3C. The thickness of the ridge, and hence its resilience, varies along its length. The thickness is highest at the end 330 and gradually tapers towards the end 331. Referring to FIGS. 3B and 3C it can be seen that the ridge protrusion 306 is provided a further protruding ridge 307 on the upper surface thereof. The ridge 307, although not preferred (the resilience of the ridge is preferably uniform across its width), can assist in providing the necessary resilience to the ridge protrusion 306.

The upper part 103 is formed from a resiliently deformable plastic material and the ridge 306 forms the resiliently deformable wall of the fluid flow passageway when the upper and lower parts are brought together to form the nozzle arrangement 101. In this regard, it is apparent that the ridge protrusion 306 is shaped to fit tightly into the groove 205 of the lower part 102 so that their respective surfaces are in tight contact when the upper and lower parts are fitted together to form the nozzle arrangement 101. This is the initial resiliently biased configuration of the resiliently deformable wall. The ridge protrusion 306 resides along the entire length of the groove 205 so that the entire length of the passageway thus formed is effectively closed. However, when the release of the contents of the aerosol canister is actuated, the pressure with which the contents access the nozzle arrangement 101 through the inlet 206 causes the wall of the internal passageway formed by the resiliently deformable ridge protrusion 306 to deform upwards and away from the surface of the groove 205, thereby opening the internal passageway and enabling the contents of the aerosol canister to flow through and be ejected through the outlet 104. In practice it is preferable that the ridge protrusion only deforms to approximately one third of the height of the channel 320 formed on the upper surface of the second part 103. This is to keep the height of the vertical channel between the top of the passageway and the top of the outlet valve (positioned directly below the aperture of the of the lower part 102) to a minimum and hence reduce the amount of product that may be retained in this vertical channel after use.

When the desired quantity of product has been dispensed through the nozzle arrangement 101, the actuation of the release of the contents is stopped by releasing the actuator portion and the resiliently deformable ridge protrusion then returns to its initial resiliently biased configuration in which its surface contacts the surface of the groove 205. In doing so, the resiliently deformable ridge 306 forces any fluid remaining within the fluid flow passageway to flow out of the outlet 104. The flow of fluid out of the outlet is further enhanced by the greater resilience of the ridge at its end 330 when compared with its end 331 (due to its greater thickness at end 330 and gradually tapering towards end 331). This causes the ridge to preferentially revert to its initial resiliently biased configuration near to the inlet so that any fluid remaining at the inlet end is displaced towards the outlet in a continuous flow-like motion.

In an alternative embodiment, the ridge protrusion 306 is provided with a circular protrusion which, when the abutment surfaces 202 and 305 are brought into contact, is received within the inlet opening 206 to form a plug to prevent any residue building up in the inlet.

To prevent any of the contents of the internal passageway from leaking and seeping between the abutment surfaces 202 and 305 during use, a horseshoe-shaped protrusion is provided on the abutment surface 305 which, when the abutment surfaces 202 and 305 are brought together, is received within the horseshoe-shaped recess 208 to form a seal which encircles the inlet and internal passageway of the nozzle arrangement 101. In an alternative embodiment, the seal may also extend across the internal passageway (i.e. the groove 205 may be provided with a recess extending across it width which receives a corresponding protrusion on the ridge protrusion 306, or vice versa) to provide an airtight seal when the nozzle arrangement 101 is not in use. The protrusion could be configured to snap-fit into the corresponding recess to form the seal. This may occur due to the elastic force with which the resiliently deformable ridge returns to its original position after use, or alternatively, an operator may have to press the protrusion into the recess.

It shall be appreciated that the description of the embodiments of the invention described in reference to the figures is intended to be by way of example only and should not construed as limiting the scope of the invention, which is defined in the appended claims.

The invention claimed is:

1. A nozzle arrangement adapted to be fitted to a pressurized vessel or container containing an expandable fluid held under pressure in the vessel or container and to permit said expandable fluid present in said vessel or container to be dispensed therethrough under pressure, said nozzle arrangement comprising:

a body including an inlet, an outlet, and walls which define an internal fluid flow passageway through which fluid can flow from said inlet to said outlet, one of said walls of the body comprising a resiliently deformable wall member; and wherein the body is formed of two interconnected parts, each of said parts having respective abutment surfaces which are contacted together, one of the parts of the body having a base for mounting to the vessel or container and an actuator portion movably attached to the base and adapted, upon operation, to engage and open an outlet valve of the pressurized vessel or container to which the arrangement is attached to enable the expandable fluid present in the pressurized vessel or container to be released into the internal fluid flow passageway, wherein the resiliently deformable wall member defines substantially the entire length of the internal fluid flow passageway, wherein, in response to an actuation of the actuator portion that causes fluid present in the pressurized vessel or container to be released into the internal fluid flow passageway, the resiliently deformable wall member undergoes a resilient deformation between an initial resiliently-biased configuration in which said substantially the entire length of the internal fluid flow passageway is closed and a distended configuration that allows fluid to flow through said internal fluid flow passageway and be dispensed through the outlet, and wherein, in response to a deactivation of the actuator portion that stops fluid present in the pressurized vessel or container from being released into the internal fluid flow passageway, the resiliently deformable wall member reverts to the initial resiliently-biased configuration such that any fluid remaining in the substantially entire length of the passageway is caused to be expelled, wherein one of the two interconnected parts comprises the resiliently deformable wall member and the other of the two interconnected parts has a corresponding wall which, together with the resiliently deformable wall member, defines said substantially the entire length of the internal fluid flow passageway.

2. A nozzle arrangement according to claim 1, wherein the outlet is defined, at least in part, by the resiliently deformable wall of the body, which is configured:

(a) to undergo a resilient deformation from an initial resiliently-biased configuration, in which the outlet is closed, to a distended configuration, in which fluid can flow through said outlet when fluid is cause to flow through the nozzle arrangement in response to the operation of said actuator portion, (b) to revert to the initial resiliently-biased configuration when the operation of the actuator portion has ceased, said initial resiliently-biased configuration causing any fluid remaining in said outlet to be expelled.

3. A nozzle arrangement according to claim 2, wherein the outlet is an open end of said passageway and the resiliently deformable wall which defines the outlet is the end of the resiliently deformable wall member which defines said substantially the entire length of the internal fluid flow passageway.

4. A nozzle arrangement according to claim 1, wherein the resilience of the resiliently deformable wall member is uniform along its length.

5. A nozzle arrangement according to claim 1, wherein the resiliently deformable wall member is adapted such that, when the operation of the actuator portion has ceased and the resiliently deformable wall reverts to the initial resiliently-biased configuration, any fluid remaining in the passageway is expelled through the outlet.

6. A nozzle arrangement according to claim 1, wherein the resilience of said resiliently deformable wall member varies along its length.

7. A nozzle arrangement according to claim 5, wherein the resilience of the resiliently deformable wall member is greater at locations disposed away from the outlet than at locations proximate to said outlet so that, when operation of the actuator portion has ceased, the internal surface fluid flow passageway resiliently deformable wall elastically recoils to a collapsed configuration at positions further way from the outlet so as to cause any fluid remaining in said portion of the internal passageway to flow towards, and be expelled through, the outlet.

8. A nozzle arrangement according to claim 7, wherein the resiliently deformable wall defines an internal surface which extends for substantially the entire length of the fluid flow passageway, and the resilience of the resiliently deformable wall is greater at an inlet end of the passageway than at positions proximate to said outlet, so that, when the operation of the actuator is ceased, the resiliently deformable wall reverts to the initial resiliently-biased configuration at the inlet so as to cause any fluid remaining in said passageway to flow towards, and be expelled through, the outlet.

9. A nozzle arrangement adapted to be fitted to a pressurized vessel or container and to permit fluid present in said vessel or container to be dispensed through the arrangement under pressure, said nozzle arrangement comprising:

a body including, an inlet, an outlet, an internal fluid flow passageway through which fluid can flow from said inlet to said outlet, an actuator portion adapted, upon operation, to engage and open an outlet valve of the pressurized vessel or container to which the arrangement is attached to enable fluid present in the pressurized vessel or container to be released into the nozzle arrangement, and wherein said body comprises a resiliently deformable wall member substantially defining the length of the fluid flow passageway, said resiliently deformable wall member being configured:

(a) to undergo a resilient deformation from an initial resiliently-biased configuration, in which the passageway is closed, to a distended configuration, in which fluid can flow through said passageway and be dispensed through the outlet when fluid is caused to flow through the nozzle arrangement in response to the operation of said actuator portion, and (b) to revert to the initial resiliently-biased configuration when the operation of the actuator portion has ceased and thereby cause any fluid remaining in the substantially entire length of the passageway to be expelled, wherein the body comprises two interconnected parts, each of said interconnected parts having respective abutment surfaces which are contacted together, wherein portions of said respective abutment surfaces form walls of the body defining said internal fluid flow passageway, and at least one of said abutment surfaces of said portions forms said resiliently deformable wall member, and wherein a resilience of said resilient deformable wall member increases proportionally with increasing distance from the outlet.

10. A nozzle arrangement according to claim 1, wherein two or more walls of the body define the internal fluid flow passageway, at least one of which is resiliently deformable and, in the initial resiliently-biased configuration, is resiliently biased against the opposing walls to define a closed passageway.

11. A nozzle arrangement according to claim 10, wherein the internal fluid flow passageway is defined by two walls of the body, at least one said walls being resiliently deformable and providing an internal surface of the passageway which is resiliently biased against the surface formed by the opposing wall in the initial resiliently-biased configuration so as to define a closed passageway.

12. A nozzle arrangement according to claim 1, wherein only one of said walls is resiliently deformable and is resiliently biased to abut the opposing wall in the resiliently biased configuration.

13. The nozzle arrangement of claim 1, wherein portions of said abutment surfaces form the walls of the body defining said internal fluid flow passageway, and wherein at least one of said portions of said abutment surfaces forms said resiliently deformable wall member.

14. A nozzle arrangement according to claim 13, wherein a first of said walls of the body comprises a groove formed in an abutment surface thereof, which extends from an inlet defined by the body to an edge of the abutment surface, said groove forming a first wall of the fluid flow passageway and being adapted to receive a corresponding resiliently deformable ridge member formed on the abutment surface of the second of the walls of the body, said ridge member being resiliently biased against the surface of said groove when the two abutment surfaces are contacted together to form said initial resiliently biased configuration, said ridge member being further configured to deform away from said groove to a distended configuration whereby an open passageway is defined when the actuator portion is operated and fluid is cased to flow through the arrangement under pressure.

15. A nozzle arrangement according to claim 13, wherein a terminus of fluid flow passageway at an edge of said abutment surfaces defines the outlet.

16. A nozzle arrangement according to claim 13, wherein said two interconnected parts are releasably connected together.

17. A nozzle arrangement according to claim 13, wherein said two interconnected parts are permanently connected together.

18. A nozzle arrangement according to claim 13, wherein said two interconnected parts are made from the same material.

19. A nozzle arrangement according to claim 18, wherein said two interconnected parts are made from a rigid/flexible plastic material.

20. A nozzle arrangement according to claim 13, wherein one of said two interconnected parts is made from a rigid plastics material and the other of said parts is made from a resiliently deformable material.

21. A nozzle arrangement according to claim 13, wherein a sealing arrangement is disposed between said abutment surfaces to prevent any fluid that leaks from said internal fluid flow passageway from seeping out of the nozzle arrangement between the two opposing abutment surfaces.

22. A nozzle arrangement according claim 1, wherein a seal is disposed in said fluid flow passageway to provide a substantially airtight seal.

23. A nozzle arrangement according to claim 22, wherein said seal comprises a groove on said resiliently deformable wall that extends across a width of the internal fluid flow passageway, said groove being adapted to receive, and form a sealing engagement with, a ridge member formed on an opposing wall when said resiliently deformable wall is in the initial resiliently biased configuration.

24. A nozzle arrangement according to claim 22, wherein said seal comprises a ridge member disposed on said resiliently deformable wall that extends across a width of the internal fluid flow passageway, said ridge member being adapted to be received by, and form a sealing engagement with, a groove member formed on an opposing wall when said resiliently deformable wall is in the initial resiliently biased configuration.

25. A nozzle arrangement according to claim 22, wherein said seal is disposed proximate to said outlet.

26. A nozzle arrangement according to claim 1, wherein the nozzle arrangement is configured such that the inlet through which fluid accesses the fluid flow passageway during use is disposed directly adjacent to the outlet of the pressurized fluid filled vessel or container to which it is adapted to be attached so that fluid dispensed through the outlet flows a minimal distance before entering the fluid flow passageway.

27. A pressurized fluid-filled vessel or container comprising an outlet valve and a nozzle arrangement as defined in claim 1 fitted thereto such that fluid ejected through said outlet during use is caused to flow through said nozzle arrangement.

28. The nozzle arrangement of claim 1, wherein said substantially the entire length of the resiliently deformable wall member comprises at least 75% of the length of the internal fluid flow passageway.

29. The nozzle arrangement of claim 1, wherein said substantially the entire length of the resiliently deformable wall member comprises at least 90% of the length of the internal fluid flow passageway.

30. The nozzle arrangement of claim 1, wherein said substantially the entire length of the resiliently deformable wall member comprises at least 98% of the length of the internal fluid flow passageway.

* * * * *